US005957121A

United States Patent [19]

Suzuki et al.

[11] Patent Number: 5,957,121

[45] Date of Patent: Sep. 28, 1999

[54] VISCOUS FLUID TYPE HEAT GENERATOR WITH HEAT-GENERATION PERFORMANCE CHANGING ABILITY

[75] Inventors: Shigeru Suzuki; Takashi Ban, both of Aichi-ken, Japan

[73] Assignee: Kabushiki Kaisha Toyoda Jidoshokki Seisakusho, Kariya, Japan

[21] Appl. No.: 08/939,934

[22] Filed: Sep. 29, 1997

[30] Foreign Application Priority Data

Oct. 1, 1996 [JP] Japan ..... 8-260452

[51] Int. Cl.[6] ..... F24C 9/00

[52] U.S. Cl. ..... 126/247; 237/12.3 R; 237/12.3 B; 122/26; 123/142.5 R; 123/142

[58] Field of Search ..... 126/247; 237/12.3 R, 237/12.3 B; 122/26; 123/142.5 R, 142

[56] References Cited

U.S. PATENT DOCUMENTS

| | | | |
|---|---|---|---|
| 4,494,524 | 1/1985 | Lee | 126/247 |
| 4,974,778 | 12/1990 | Bertling | 237/12.3 B |
| 4,993,377 | 2/1991 | Itakura | 123/142.5 R |
| 5,279,262 | 1/1994 | Muehleck | 122/26 |
| 5,704,320 | 1/1998 | Ban et al. | 122/26 |
| 5,727,510 | 3/1998 | Ban et al. | 123/142.5 R |
| 5,765,545 | 6/1998 | Ban | 126/247 |
| 5,771,712 | 3/1999 | Moroi | 126/247 |
| 5,788,151 | 8/1998 | Mori et al. | 237/12.3 R |
| 5,871,149 | 2/1999 | Moroi et al. | 237/12.3 R |
| 5,875,740 | 3/1999 | Ban et al. | 123/142.5 R |
| 5,875,741 | 3/1999 | Moroi et al. | 126/247 |
| 5,875,742 | 3/1999 | Moroi et al. | 122/26 |
| 5,878,951 | 3/1999 | Moroi et al. | 237/12.3 R |
| 5,881,682 | 3/1999 | Hirose et al. | 122/26 |
| 5,881,953 | 3/1999 | Moroi et al. | 237/12.3 R |

FOREIGN PATENT DOCUMENTS 398107 10/1991 Japan .

*Primary Examiner*—Larry Jones
*Attorney, Agent, or Firm*—Morgan & Finnegan LLP

[57] ABSTRACT

A viscous fluid type heat generator having a heat generating chamber in which heat generation by the viscous fluid is carried out in response to the rotation of a rotor element applying a shearing action to the viscous fluid, a heat generation control chamber for containing the viscous fluid to be supplied into the heat generating chamber and receiving the viscous fluid withdrawn from the heat generating chamber so that an ability of quickly increasing and decreasing the heat generating performance of the heat generator is achieved in response to a requirement for a change in the supply of heat to be exchanged with a heat exchanging liquid of a heating system. The heat generator has a fluid supplying passage, a fluid withdrawing passage, a fluid supplying recessed groove in the heat generating chamber, and a subsidiary fluid supplying passageway which are arranged so as to provide a fluid communication between the heat generating chamber and the heat generation control chamber. The heat generating performance is quickly reduced by withdrawing the viscous fluid from the heat generating chamber into the heat generation control chamber via the fluid withdrawing passage, and the heat generating performance is quickly increased by supplying the viscous fluid from the heat generation control chamber into the heat generating chamber via the fluid supplying and subsidiary fluid supplying passages.

12 Claims, 4 Drawing Sheets

VISCOUS FLUID TYPE HEAT GENERATOR WITH HEAT-GENERATION PERFORMANCE CHANGING ABILITY

BACKGROUND OF THE INVENTION

1. Field of the Invention

The present invention generally relates to a viscous fluid type heat generator in which heat is generated by forcibly shearing a viscous fluid confined in a chamber and the heat is transmitted to a heat exchanging liquid circulating through a heating system. More particularly, the present invention relates to a viscous fluid type heat generator provided within an ability to quickly change a heat-generation performance in response to a change in a requirement for either increasing or reducing heating to be applied to an objective heated area.

2. Description of the Related Art

Japanese Unexamined (Kokai) Utility Model Publication No. 3-98107 (JU-A-3-98107) discloses a viscous fluid type heat generator adapted for being incorporated into an automobile heating system as a supplemental heat source. The viscous fluid type heat generator of JU-A-3-98107 is formed as a heat generator provided with a unit for changing a heat-generation performance. The heat generator of JU-A-3-98107 includes front and rear housings connected together to form a housing assembly in which a heat generating chamber for permitting a viscous fluid to generate heat, and a heat receiving chamber arranged adjacent to the heat generating chamber for receiving the heat from the heat generating chamber, are formed. The heat receiving chamber in the housing assembly permits a heat exchanging liquid to flow therethrough and to receive heat from the viscous fluid in the heating generating chamber. The heat exchanging liquid is circulated through the heat receiving chamber and a separate heating circuit of the automobile heating system so as to supply the heat to the objective area, e.g., a passenger compartment of the automobile during the operation of the heating system. Thus, the housing assembly of the heat generator has an inlet port and an outlet port through which the heat exchanging liquid flows into and out of the heat receiving chamber. The heat generator of JU-A-3-98107 further includes a drive shaft rotatably supported by bearings which are seated in the front and rear housings of the housing assembly. A rotor element is mounted on the drive shaft so as to be rotated together with the drive shaft within the heat generating chamber. The inner wall surface of the heat generating chamber and the outer surfaces of the rotor element define labyrinth grooves in which the viscous fluid such as silicone oil having a chain-molecular structure is held to generate heat, in response to the rotation of the rotor element.

The heat generator of JU-A-3-98107 has such a characteristic arrangement that upper and lower housings are attached to a bottom portion of the housing assembly to form a heat generation control chamber therein. The heat generation control chamber is formed as a volume-variable chamber having a wall consisting of a membrane such as a diaphragm.

The heat generating chamber communicates with the atmosphere via a through-hole bored in an upper portion of the front and rear housings of the housing assembly, and with the heat generation control chamber via a communicating channel arranged between the heat generation control chamber and the heat generating chamber. The volume of the heat generation control chamber is adjustably changed by the movement of the diaphragm which is caused by a spring element having a predetermined spring factor or an externally supplied signal such as a pressure signal supplied from an engine manifold of an automobile.

When the drive shaft of the heat generator of JU-A-3-98107 incorporated in an automobile heating system is driven by an automobile engine, the rotor element is rotated within the heat generating chamber, so that heat is generated by the viscous fluid to which a shearing force is applied between the inner wall surface of the heat generating chamber and the outer surfaces of the rotor element. The heat generated by the viscous fluid is transmitted from the heat generating chamber to water circulating through the heating system and carried by the water to a heating circuit of the heating system to warm an objective heated area such as a passenger compartment.

When it is detected that the objective area is excessively heated with respect to a reference temperature value predetermined for that area, through the detection of the temperature of the viscous fluid, the diaphragm of the heat generation control chamber is moved in response to a vacuum pressure signal supplied from the engine manifold to increase the volume of the heat generation control chamber. Accordingly, the viscous fluid is withdrawn from the heat generating chamber into the heat generation control chamber to reduce generation of heat by the viscous fluid between the inner wall surface of the heat generating chamber and the outer surfaces of the rotor element. Therefore, the heat generating performance can be reduced, i.e., application of heat to the objective heated area becomes weak.

When it is detected that heating of the objective heated area is excessively weak with respect to the predetermined reference temperature value, through the detection of the temperature of the viscous fluid, the diaphragm of the heat generation control chamber is moved by the pressure signal and by the spring force of the spring element to reduce the volume of the heat generation control chamber. Therefore, the viscous fluid contained in the heat generation control chamber is supplied into the heat generating chamber so as to increase heat generation by the viscous fluid between the inner wall surface of the heat generating chamber and the outer surfaces of the rotor element. As a result, the heat generating performance can be increased, i.e., application of heat to the objective heated area becomes strong.

Nevertheless, in the variable heat generating performance, viscous fluid type heat generator of JU-A-3-98107, when the viscous fluid is withdrawn from the heat generating chamber into the heat generation control chamber, the atmospheric air is introduced from the through-hole of the housing assembly into the heat generating chamber so as to remove a vacuum occurring in the heat generating chamber due to the withdrawal of the viscous fluid therefrom. Thus, the viscous fluid must come into contact with the atmospheric air many times when the change of the heat generating performance occurs, and is oxidized. Therefore, a gradual degradation of the heat generating characteristics of the viscous fluid occurs. Further, the above-mentioned through-hole formed in the housing assembly permits a certain amount of moisture to enter from the atmosphere into the heat generating chamber of the heat generator, and accordingly, the viscous fluid is adversely affected by the moisture within the heat generating chamber after a long operation time of the heat generator, so that the heat generating characteristics of the viscous fluid must be again degraded.

The copending Japanese Patent Application No. 7-285266 discloses a different viscous fluid type heat generator having a variable heat-generating performance, in which a heat generating chamber defined in a housing assembly is fluid-tightly sealed and, a rotor element is rotated within the fluid-tight heat generating chamber to apply a shearing force to a viscous fluid held in gaps between the inner wall surface of the heat generating chamber and outer surfaces of the rotor element. Therefore, the viscous fluid in the heat generating chamber does not come into contact with the air and the moisture in the atmosphere and accordingly, the viscous fluid is degraded by neither the air nor the moisture. Therefore, the heat generator of the copending Japanese Patent Application No. 7-285266 is improved over that of JU-A-3-98107. Nevertheless, the variable heat-generating performance type heat generator of the copending Japanese Patent Application No. 7-285266 must still suffer from an unsatisfactory performance from the viewpoint of a quickly responding function in changing the heat-generating performance from a high to low performance when a heated area is excessively heated, and from a low to high performance when the heated area needs to be heated.

The viscous fluid type heat generator of the copending Japanese Patent Application No. 7-285266 includes a fluid-tight heat generating chamber in which a rotor element can be rotated to apply a shearing force to the heat-generating viscous fluid, a heat receiving chamber through which a heat exchanging liquid circulates to receive heat from the heat generating chamber, a heat generation control chamber capable of communicating with the heat generating chamber via a fluid withdrawing passage and via a fluid supply passage, and a control valve unit movable to regulate opening and closing of the fluid withdrawing and fluid supplying passages depending on a change in the temperature of the viscous fluid.

Due to the above-mentioned construction of the heat generator, a regulated withdrawal of the viscous fluid from the fluid-tight heat generating chamber into the heat Generation control chamber, and a regulated supply of the viscous fluid from the heat generation control chamber to the fluid-tight heat generating chamber can achieve a desired change in the heat generating performance of the heat generator.

The operation of the variable heat-generating performance, viscous fluid type heat generator of the copending Japanese Patent Application No. 7-285266 will be further described hereinbelow, with reference to FIGS. 5 through 7.

When it is required that the heat generator is able to quickly reduce the heat generating performance thereof at a given high temperature "A" (FIG. 5) of the viscous fluid, and to quickly increase the heat generating performance thereof at a given low temperature "B" (FIG. 5) of the viscous fluid, the control valve unit will be arranged, for example, so as to fully open the fluid withdrawing passage while simultaneously fully closing the fluid supplying passage when the temperature of the viscous fluid is at "A", and to fully close the withdrawing passage while simultaneously fully opening the fluid supplying passage when the temperature of the viscous fluid is at "B". However, as will be understood from FIG. 5, with the described arrangement of the control valve unit, it occurs that when the temperature of the viscous fluid approaches a given intermediate temperature "C" (FIG. 5) between the above high and low temperatures "A" and "B", the control valve unit is moved to its position where the unit closes the fluid withdrawing passage until the passage is brought to a state immediately before it is completely closed. Simultaneously, the control valve unit brings the fluid supplying passage to a state where it is opened slightly. At this moment, the viscous fluid in the heat generating chamber generates heat to cause a rise in a pressure thereof within the heat generating chamber. Thus, the viscous fluid is urged by the pressure to flow and leak from the heat generating chamber into the heat generation control chamber via the fluid withdrawing passage. On the other hand, since the fluid supplying passage is in a slightly (incompletely) opened position, and since a pressure rise within the heat generation control chamber is smaller than that in the heat generating chamber, a substantial supply of the viscous fluid from the heat generation control chamber into the heat generating chamber does not take place, and therefore, the heat generating performance of the heat generator is reduced while reducing a supply of heat from the heat generator to the heating system. As a result, the temperature of the viscous fluid is gradually lowered, and the rise in the pressure within the heat generating chamber is stopped to terminate leaking of the viscous fluid from the heat generating chamber into the heat generation control chamber. Further, when the temperature of the viscous fluid arrives at "C", and even if the fluid supply passage is widely opened by the control valve unit, the supplying of the viscous fluid from the heat generation control chamber to the heat generating chamber via the widely opened fluid supplying passage does not immediately take place because a fluid continuation, due to the viscosity, between the viscous fluid in the heat generation control chamber and that in the heat generating chamber through the fluid supply passage is broken when the fluid supplying passage approaches its closed condition. That is, the supply of the viscous fluid from the heat generation control chamber into the heat generating chamber starts with a given time of delay. When the temperature of the viscous fluid is further lowered from the temperature "C" of FIG. 5, the fluid withdrawing passage is completely closed and, the supply of the viscous fluid from the heat generation control chamber toward the heat generating chamber via the fluid supplying passage starts. Therefore, it is understood that in this heat generator, an increase in the heat generation performance cannot be achieved until the temperature of the viscous fluid drops to a temperature lower than the temperature "C". Accordingly, when the temperature of the viscous fluid is higher than "C" but appreciably lower than "A" in FIG. 5, even if an objective heated area demands to be quickly heated, the heat generator cannot quickly respond to such a demand. Namely, the response characteristics of the heat generator to the requirement for an increase in the heat generating performance is not satisfactory in a low temperature range of the viscous fluid, i.e., a low temperature range of the objective heated area.

On the other hand, when the heat generator is required to improve the characteristics thereof in response to a requirement for quickly increasing the heat generating performance of the heat generator when the temperature of the viscous fluid is at around an intermediate temperature "C", the control valve unit must be arranged so as to completely close the fluid withdrawing passage and simultaneously, to completely open the fluid supplying passage when the temperature of the viscous fluid arrives at "C" as shown in FIG. 6. Nevertheless, in the above-mentioned arrangement of the control valve unit, the fluid withdrawing passage is not sufficiently opened, and the fluid supplying passage is closed to a state immediately before it is completely closed when the temperature of the viscous fluid arrives at a given high temperature "A". Thus, the viscous fluid within the heat generating chamber cannot be smoothly withdrawn therefrom into the heat generation control chamber, and accordingly, a reduction in the heat generating performance thereof cannot be quickly achieved at the high temperature "A". Therefore, a response characteristics of the heat generator to a requirement for quickly reducing the heat generating performance in a high temperature range becomes worse to result in causing a thermal degradation of the viscous fluid.

Further, if the control valve unit of the abovementioned viscous fluid type heat generator of the copending Japanese Patent Application No. 7-285266 is arranged only so as to reduce the heat generating performance at a given high temperature of the viscous fluid, a bad response characteristics to a requirement for a quick increase in the heat generating performance must result as shown in FIG. 7. In FIG. 7, the temperature of the viscous fluid, i.e., a controlled variable, is replaced with the number of rotations of the drive shaft of the heat generator and shown in the abscissa, and the amount of heat generation by the viscous fluid is replaced with a torque, and shown in the ordinate. It will be understood from the graph of FIG. 7 that a curve illustrating a relationship between the number of rotations of the drive shaft and the torque demonstrates a hysteretic curve shown by a →b→c→a. This indicates that when the number of rotations of the drive shaft is reduced, and when a quick heating of an objective heated area is required, such requirement cannot be achieved quickly.

SUMMARY OF THE INVENTION

Therefore, an object of the present invention is to provide a viscous fluid type heat generator having an ability of changing the heat generating performance thereof and being capable of exhibiting a good response characteristics to a requirement for both increasing the heat generating performance in a low temperature range of the viscous fluid and reducing the heat generating performance in a high temperature range of the viscous fluid.

Another object of the present invention is to provide a variable heat generating performance, viscous fluid type heat generator constructed in such a manner that degradation of the heat generating characteristics of the viscous fluid, typically a silicone oil, can be prevented over a long operation time of the heat generator.

In accordance with the present invention, there is provided a variable heat generating performance, viscous fluid type heat generator comprising:

- a housing assembly defining therein a fluid-tight heat generating chamber in which heat is generated, and a heat receiving chamber arranged adjacent to the fluid-tight heat generating chamber to permit a heat exchanging fluid to circulate therethrough to thereby receive heat from the fluid-tight heat generating chamber, the fluid-tight heat generating chamber having inner wall surfaces thereof;
- a drive shaft supported by the housing assembly to be rotatable about an axis of rotation thereof, the drive shaft being operatively connected to an external rotation-drive source;
- a rotor element mounted to be rotationally driven by the drive shaft for rotation together therewith within the fluid-tight heat generating chamber, the rotor element having outer faces confronting the inner wall surfaces of the fluid-tight heat generating chamber via predetermined amount of gaps;
- a viscous fluid, filling the gap between the inner wall surfaces of the fluid-tight heat generating chamber of the housing assembly and the outer faces of the rotor element, for heat generation during the rotation of the rotor element, wherein the housing assembly further comprises:

- a heat generation control chamber formed therein to have a given amount of volume for containing the viscous fluid therein;
- a fluid withdrawing passage for passing the viscous fluid from the heat generating chamber toward the heat generation control chamber to thereby permit at least a part of the viscous fluid in the heat generating chamber to be withdrawn into the heat generation control chamber, the fluid withdrawing passage having opposite open ends thereof;
- a fluid supplying passage for passing the viscous fluid from the heat generation control chamber toward the heat generating chamber to thereby permit at least a part of the viscous fluid in the heat generation control chamber to be supplied into the heat generating chamber, the fluid supplying passage having opposite open ends;
- a subsidiary fluid supplying passageway for providing a predetermined constant fluid communication between the heat generation control chamber and the heat generating chamber, the subsidiary fluid supplying passageway constantly supplying a given amount of viscous fluid from the heat generation control chamber to the heat generating chamber;
- a fluid withdrawal control valve for openably closing at least one of the opposite open ends of the fluid withdrawing passage, the fluid withdrawal control valve opening at least one of the opposite open ends of the fluid withdrawing passage when the viscous fluid should be withdrawn from the heat generating chamber to reduce a heat generating performance of the heat generator; and,
- a fluid supply control valve for openably closing at least one of the opposite ends of the fluid supplying passage, the fluid supply control valve opening at least one of the opposite ends of the fluid supplying passage when the viscous fluid should be supplied from the heat generation control chamber into the heat generating chamber to increase the heat generating performance of the heat generator.

When the fluid supplying passage is opened by the fluid supply control valve, and when the fluid withdrawing passage is closed by the fluid withdrawal control valve, the viscous fluid within the heat generating chamber has a fluid continuity with that within the heat generation control chamber through the opening fluid supplying passage due to a stretch viscosity thereof, but has no fluid continuity with that within the heat generation control chamber through the closing fluid withdrawing passage. Thus, the viscous fluid within the heat generating chamber is not withdrawn therefrom into the heat generation control chamber, and a part of the viscous fluid within the heat generation control chamber is supplied into the heat generating chamber. Accordingly, heat generation by the viscous fluid held between the inner wall surface of the heat generating chamber and the outer surfaces of the rotor element within the heat generating chamber is increased to increase the heat generating performance of the heat generator. Therefore, an application of heat to an objective heated area is increased by a heating system in which the viscous fluid heat generator is incorporated.

On the other hand, when the fluid supplying passage is closed by the fluid supply control valve, and when the fluid withdrawing passage is opened by the fluid withdrawal control valve, the viscous fluid within the heat generating chamber has a fluid continuity with that within the heat generation control chamber through the opening fluid withdrawing passage due to the stretch viscosity thereof, but has no fluid continuity with that within the heat generation control chamber through the closing fluid supplying passage. Therefore, a part of the viscous fluid within the heat generating chamber is withdrawn therefrom into the heat generation control chamber via the opening fluid withdrawing passage. Nevertheless, no viscous fluid is supplied from the heat generation control chamber into the heat generating chamber via the closed fluid supplying passage. Thus, a reduction in the heat generating performance of the heat generator occurs so as to reduce heat supply from the heat generator to the heating system. Accordingly, heating of the objective heated area is weakened. Further, when the heat generating performance is reduced, even if the rotating speed of the drive shaft of the heat generator is maintained at a high speed, the viscous fluid within the heat generating chamber is suppressed from having a high temperature, and accordingly, degradation of the heat generating characteristics of the viscous fluid can be prevented.

In the described viscous fluid type heat generator, the subsidiary fluid supplying passageway can constantly supply a predetermined small amount of viscous fluid from the heat generation control chamber into the heat generating chamber. Therefore, if the viscous fluid leaks from the heat generating chamber into the heat generation control chamber through the incompletely closed fluid withdrawing passage, such leakage of the viscous fluid from the heat generating chamber can be suitably compensated for by the above-mentioned viscous fluid supplied via the subsidiary fluid supplying passage. Namely, a lack of the viscous fluid within the heat generating chamber due to the leakage of the viscous fluid does not occur. Accordingly, good response characteristics of the heat generator to the requirement for both a reduction in the heat generating performance in the high temperature range of the viscous fluid and an increase in the heat generating performance in the low temperature range of the viscous fluid can be achieved satisfactorily.

Further, in the described viscous fluid type heat generator, during the withdrawing of the viscous fluid from the heat generating chamber into the heat generation control chamber, and also during the supplying of the viscous fluid front the heat generation control chamber to the heat generating chamber, a total internal volume of the heat generating chamber, the fluid withdrawing passage, the fluid supplying passage, the subsidiary fluid supplying passage, and the heat generation control chamber of the housing assembly is unchanged, and accordingly, the flow or movement of the viscous fluid does not generate a vacuum portion within the housing assembly. Thus, no fresh air is introduced into the afore-mentioned heat generating chamber, the fluid withdrawing passage, the fluid supplying passage, the subsidiary fluid supplying passage, and the heat generation control chamber, and accordingly, the viscous fluid filled in the heat generator does not come into contact with fresh air. Thus, degradation of the heat generating characteristics of the viscous fluid can be prevented. In addition, since a moisture component in the atmosphere is not permitted to enter into the housing assembly, the viscous fluid is not adversely affected by the moisture. Therefore, the heat generating characteristics of the viscous fluid can be constant over a long operation life of the heat generator.

Preferably, when the drive shaft and the rotor element are arranged to have a substantially horizontal common axis of rotation thereof, the fluid withdrawing passage is formed to fluidly communicate with a central portion of the heat generating chamber arranged around the horizontal axis of rotation of the rotor element, so that the viscous fluid is withdrawn through the fluid withdrawing passage under the Weissenberg Effect of the viscous fluid during the heat generating operation of the heat generator.

Since the viscous fluid in the heat generating chamber is caused to turn in a direction perpendicular to the liquid surface while the rotor element is rotated, the viscous fluid is collected by the Weissenberg Effect toward the axis of rotation of the rotor element against centrifugal force applied thereto. It should be noted that the Weissenberg Effect of the viscous fluid which is a non-Newtonian fluid having a high viscosity, is a kind of change in a normal stress of the non-Newtonian fluid, and causes the viscous fluid to collect toward the center of rotation against a centrifugal force applied by the rotor element especially during a low rotating speed of the rotor element. When the rotating speed of the rotor element increases, the effect of the centrifugal force on the viscous fluid becomes stronger than that of the Weissenberg Effect.

Therefore, during the low rotating speed of the rotor element and the drive shaft, the viscous fluid within the heat generating chamber can be withdrawn by the Weisserberg Effect into the heat generation control chamber via the fluid withdrawing passage arranged to fluidly communicate with the central portion of the heat generating chamber.

Preferably, the subsidiary fluid supplying passageway is formed to have a cross-sectional area smaller than that of the fluid withdrawing passage.

The subsidiary fluid supplying passageway can operate so as to establish a constant fluid communication between the heat generating chamber and the heat generation control chamber, and therefore, a given small amount of viscous fluid supplied from the heat generation control chamber into the heat generating chamber may compensate for leakage of the viscous fluid from the heat generating chamber into the heat generation control chamber via the fluid withdrawing chamber.

Preferably, when the drive shaft and the rotor element are arranged to have a substantially horizontal common axis of rotation thereof, the fluid withdrawing passage is arranged to have opposite open ends, one of which opens toward the heat generation control chamber in which a predetermined amount of the viscous fluid is initially filled to reach a given fluid level, and the other of which opens toward the heat generating chamber. The open end of the fluid withdrawing passage is arranged to be constantly positioned above the fluid level of the viscous fluid within the heat generation control chamber, regardless of a change in the fluid level of the viscous fluid.

Further, the fluid supplying passage is arranged to have opposite ends, one of which opens into the heat generation control chamber and is constantly positioned below the fluid level of the viscous fluid regardless of a change in the fluid level of the viscous fluid.

Still further, the subsidiary fluid supplying passageway is arranged to have opposite ends, one of which opens into the heat generation control chamber and is positioned below the open end of the fluid supplying passageway.

According to the above-described arrangement of the fluid withdrawing, fluid supplying and subsidiary fluid supplying passages, before starting of the heat generator, the viscous fluid filled in both heat generating and heat generation control chambers takes identical fluid levels within respective chambers, due to gravity in the heat generation and heat generating chambers, and due to the pressure of a gas, typically, the air confined in the heat generating and heat generation control chambers. Thus, when the heat generator is started after the stopping of the operation thereof for a while, the amount of the viscous fluid within the heat generating chamber is reduced, and accordingly, when the heat generator is started its operation, the amount of the viscous fluid sheared by the rotating rotor element is relatively small. Therefore, a load applied to the rotor element and the drive shaft can be small. Accordingly, the starting of the heat generator can be easily achieved by an application of a small starting torque from an external drive source. This fact means that any mechanical shock generating at the moment of the start of the operation of the heat generator can be suppressed. During the initial operation of the heat generator, the viscous fluid is spread by the rotating rotor element over many portions of the heat generating chamber, so that heat generation by the viscous fluid held between the inner wall surface of the heat generating chamber and the outer surfaces of the rotor element is gradually increased.

During the heat generating operation of the heat generator, the viscous fluid confined within the heat generating chamber, which usually contains therein gas bubbles, typically air bubbles, is subjected to a shearing action by the rotor element. Thus, the gas bubbles are broken and ooze out of the viscous fluid while the latter is continuously sheared by the rotor element. Therefore, when the open end of the fluid withdrawing passage opening into the heat generation control chamber is positioned above the fluid level of the viscous fluid within the heat generation control chamber, the gas easily flows from the heat generating chamber into the heat generation control chamber through the fluid withdrawing passage. Further, the above-described construction of the viscous fluid type heat generator permits the viscous fluid within the heat generating chamber and that within the heat generation control chamber to easily replace one another under the effect of gravity on the viscous fluid. Moreover, the rotating rotor element can easily draw the viscous fluid from the heat generation control chamber into the heat generating chamber by the use of the surface tension of the viscous fluid through the fluid supplying and subsidiary fluid supplying passages. At this stage, since the subsidiary fluid supplying passageway is located below the fluid supplying passage, the viscous fluid can be surely supplied from the heat generation control chamber into the heat generating chamber via the subsidiary fluid supplying passage. To this end, a quick reduction in the heat generating performance and a quick increase in the heat generating performance can be achieved.

When the rotation of the rotor element is stopped, the fluid levels in the heat generating chamber and in the heat generation control chamber become equal due to the movement or the gas between both chambers and due to the gravity of the viscous fluid in both chambers. The movement of the gas easily occurs through the fluid withdrawing passage, and no provision of a specified gas passage is needed.

Preferably, the fluid supplying passage may include a recessed radial groove formed in a part of the inner wall surfaces of the heat generating chamber at a position facing the rotor element and radially extending toward a position adjacent to the outer periphery of the rotor element. The radial recessed groove of the fluid supplying passage has an end opening into the heat generation control chamber.

Then, the subsidiary fluid supplying passageway is formed to fluidly communicate with the radial recessed groove of the fluid supplying passage, so that a part of the viscous fluid within the heat generation control chamber is supplied into the heat generating chamber via the subsidiary fluid supplying passageway and the radial recessed groove of the fluid supplying passage.

The above construction of the fluid supplying passage including the radial recessed groove permit the viscous fluid to be supplied into the heat generating chamber at a position adjacent to the outer periphery of the rotor element via the radial recessed groove. The viscous fluid is subsequently moved toward the central portion of the heat generating chamber due to the Weissenberg Effect due to the rotation of the rotor element, and is spread over the overall area between the outer faces of the rotor element and the inner wall surface of the heat generating chamber. Thus, the heat generation by the viscous fluid within the heat generating chamber is quickly increased. Further, the viscous fluid in the heat generation control chamber can be surely supplied into the heat generating chamber via the subsidiary fluid supplying passageway and the radial recessed groove of the fluid supplying passage.

Preferably, the fluid supply control valves of the viscous fluid type heat generator may comprise a bimetallic flap valve arranged in the heat generation control chamber so as to close the open end of the fluid supplying passage opening into the heat generation control chamber, in response to a rise in the temperature of the viscous fluid within the heat generation control chamber. Then, the subsidiary fluid supplying passageway is arranged so as to pierce a portion of the bimetallic flap valve. When the temperature of the viscous fluid within the heat generation control chamber is lowered with respect to a predetermined reference temperature, the bimetallic flap valve opens the fluid supplying passage fluidly communicated with the heat generation control chamber. When the fluid supplying passage communicates with the heat generation control chamber due to the opening of the bimetallic flap valve, the viscous fluid is supplied from the heat generation control chamber into the heat generating chamber to increase the heat generation by the viscous fluid within the heat generating chamber.

When the bimetallic flap valve closes the fluid supplying passage, the supply of the viscous fluid from the heat generation control chamber into the heat generating chamber is stopped to stop an increase in heat generation by the viscous fluid within the heat generating chamber. Thus, the supply of heat from the heat generator to the associated heating system is reduced to reduce the heating of the objective heated area.

Further, according to the provision of the bimetallic flap valve of the fluid supply control valve, the heat generator can operate so as to increase the heat generating performance thereof in response to an increase in the viscous fluid confined within the heat generator per se. Namely, it is not necessary for the heat generator to have an additional device for generating a heat increase command signal to be externally applied to the heat generator. Thus, the heating system incorporating therein the viscous fluid type heat generator may be a low cost type heating system.

Further, the fluid withdrawal control valve of the viscous fluid type heat generator may comprise a bimetallic flap valve arranged in the heat generation control chamber, the bimetallic flap valve being normally closed to close at least one of the opposite open ends of the fluid withdrawing passage opening into the heat generation control chamber, and moving away from the closed position thereof, in response to a rise in the temperature of the viscous fluid.

In the above-described viscous fluid type heat generator, the rotor element, operable to apply a shearing action to the viscous fluid during rotation thereof, may be formed as a flat rotary disc having a central portion thereof at which the flat rotary disc is mounted on the drive shaft. Thus, the viscous fluid is spread over the opposite circular flat faces of the rotor element perpendicular to the axis of rotation of the rotor element, and accordingly, the viscous fluid may be surely subjected to the Weissenberg Effect during the rotation of the rotor element.

Further, the rotor element may be provided with at least one through-hole formed in a central portion thereof to provide a fluid communication between fluid holding gaps on the opposite sides of the rotor element within the heat generating chamber. The through-hole of the rotor element permits the viscous fluid to be easily withdrawn from the gap between the front inner wall surface of the heat generating chamber into the heat generation control chamber through the through-hole when the heat generating performance of the heat generator should be reduced. Further, when the heat generating performance of the heat generator should be increased, the viscous fluid can be easily supplied from the heat generation control chamber into the fluid holding gaps on the opposite sides of the rotor element via the through-hole of the rotor element.

BRIEF DESCRIPTION OF THE DRAWINGS

The above and other objects, features and advantages of the present invention will be made more apparent from the ensuing description of the preferred embodiments of the present invention with reference to the accompanying drawings wherein.

DESCRIPTION OF THE PREFERRED EMBODIMENTS

Figure 1:
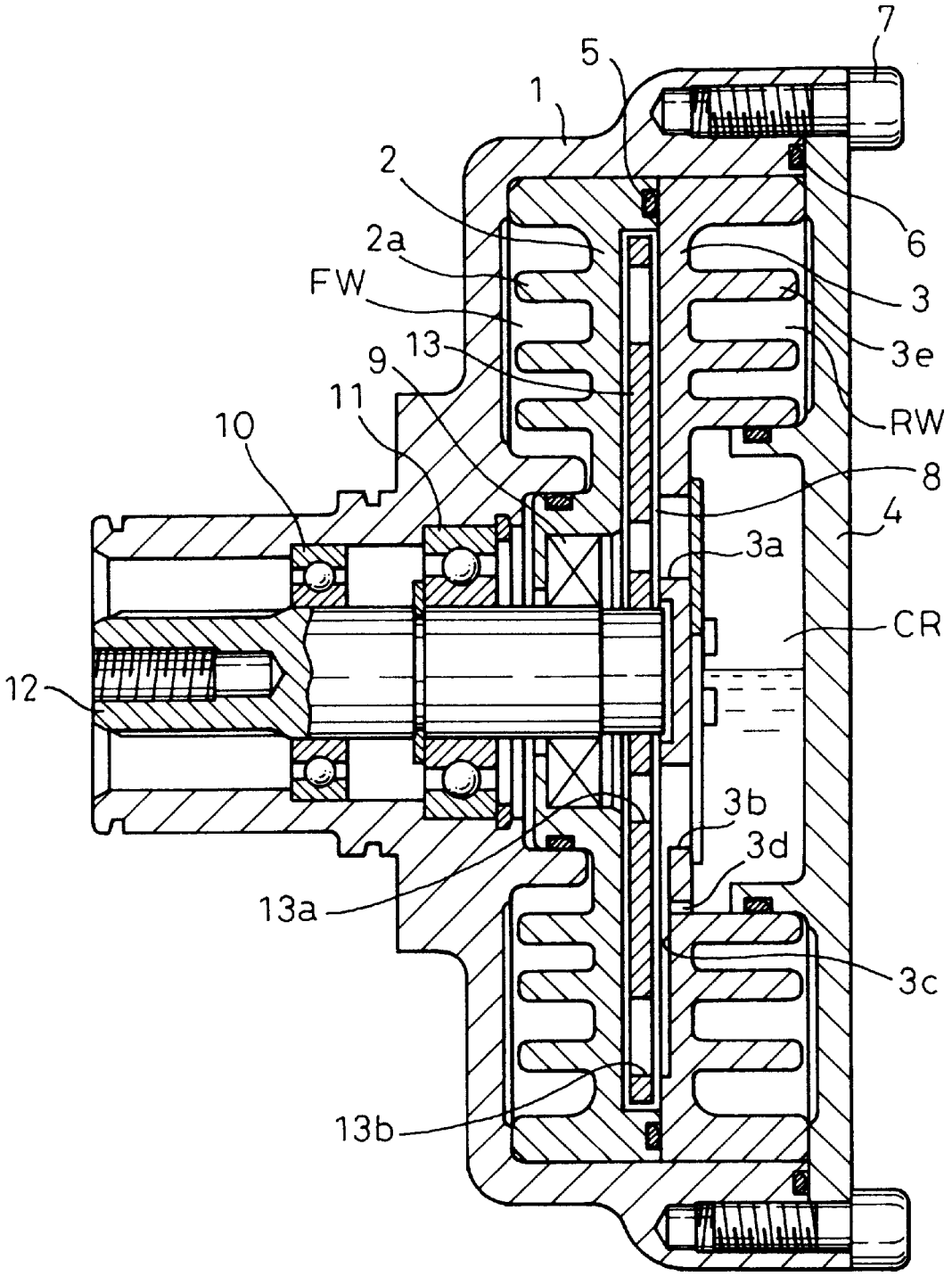
FIG. 1 is a central cross-sectional view of a viscous fluid type heat generator according to a first embodiment of the present invention, in which the front side is at the left hand side and the rear side is at the right hand side.

Referring to FIG. 1, the viscous fluid type heat generator having the ability to quickly change the heat generating performance thereof, according to the first embodiment of the present invention includes a housing assembly generally formed by a front housing body 1, a front plate element 2, a rear plate element 3, and a rear housing body 4. The front and rear plate elements 2 and 3 are accommodated in the front housing body 1 and are axially connected together via a sealing element 5 made of an O-ring and arranged at an outer peripheral portions of the front and rear plate elements 2 and 3. The front housing body 1 has a rear open end to which the rear housing 4 is fixed by means of a plurality of screw bolts 7 so as to close the open end of the front housing body 1. A sealing element 6 similar to the sealing element 5 is interposed between the end of the front housing body 1 and an outer peripheral portion of the rear housing body 4.

The front plate element 2 is provided with a circular recess formed in a rear end face thereof and cooperates with a front end face of the rear plate element 3 so as to define a heat generating chamber 8 in which heat generation by a viscous fluid, typically a silicone oil, occurs when the viscous fluid is subjected to a shearing action by the rotation of a later-described rotor element 13.

Figure 2:
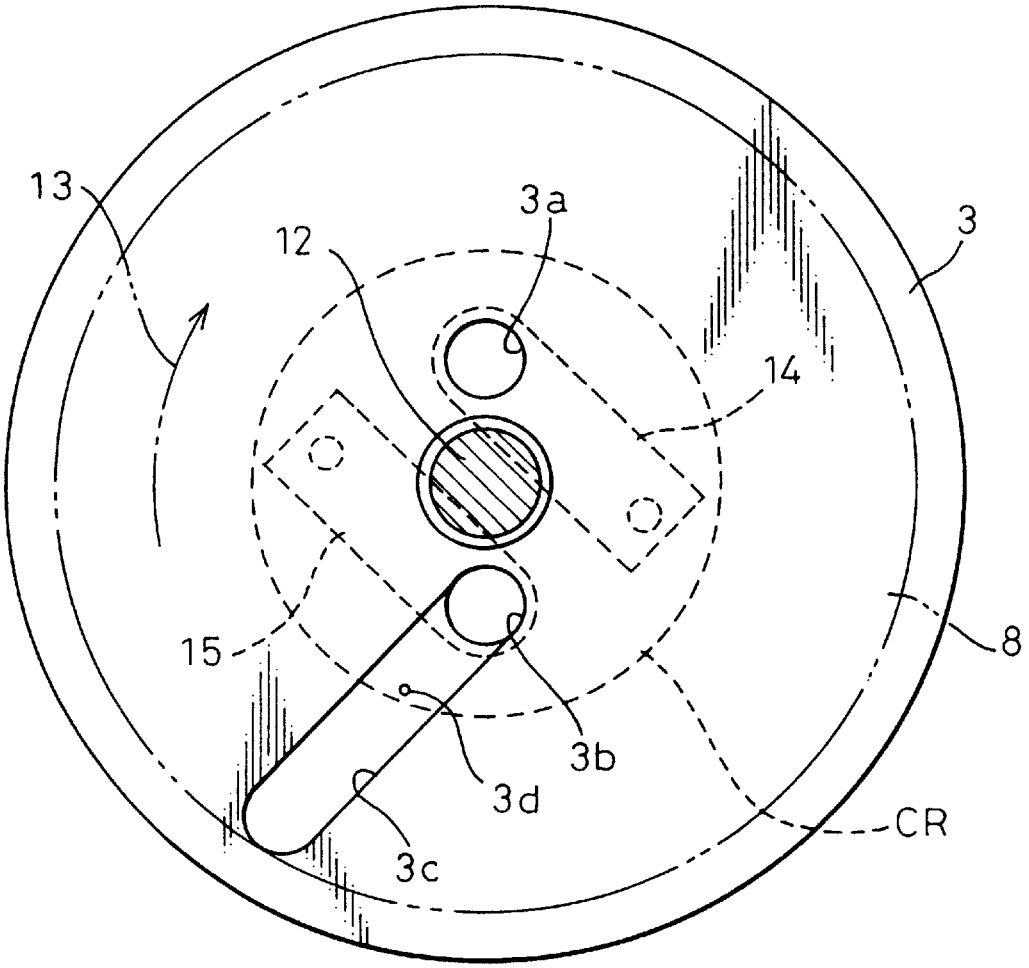
FIG. 2 is a plan view of a rear plate element incorporated in the heat generator of FIG. 1, viewed from the front side thereof.

As shown in FIG. 2 in addition to FIG. 1, the rear plate element 3 is provided with a through-bore 3*a* formed as a later-described fluid withdrawing passage. The through-bore 3*a* is arranged so as to open into the heat generating chamber 8 at an upper position of a radially central area extending around the center of the heat generating chamber 8. The rear plate element 3 is also provided with a through-bore 3*b* formed as a laterdescribed fluid supplying passage. The through-bore 3*b* is arranged so as to open into the heat generating chamber 8 at a lower position of the radially central area of the heat generating chamber 8. The rear plate element 3 is further provided with a recessed groove 3*c* extending radially from the open end of the through-bore 3*b* toward a lower position of the heat generating chamber 8 as shown in FIG. 1. The recessed groove 3*c* is formed as a portion of a fluid supplying passage to supply the viscous fluid into the heat generating chamber 8, and guides the flow of the viscous fluid toward the lowermost region in the heat generating chamber 8. The rear plate element 3 is further provided with a through-hole 3*d* formed as a subsidiary fluid supplying passage. The through-hole 3*d* is arranged so as to be positioned below the above-mentioned through-bore 3*b* formed as the fluid supplying passage, and to open in the recessed groove 3*c*.

The through-bores 3*a* and 3*b* are formed to have a substantially identical bore diameter, and the through-hole 3*d* is formed to have a bore diameters sufficiently smaller than that of the through-bores 3*a* and 3*b*.

The front plate element 2 is provided with a plurality of circular fins 2*a* formed in a radially outer region of the front face thereof. The fins 2*a* project frontward and cooperate with an inner wall surface of the front housing body 1 to define a front heat receiving chamber FW arranged adjacent to a front portion of the heat generating chamber 8 to receive therein a later-described heat exchanging liquid which receives heat from the front portion of the heat generating chamber 8.

The rear plate element 3 is provided with a plurality of circular fins 3*e* formed in a radially outer region of the rear face thereof. The fins 3*e* project rearward and cooperate with an inner wall surface of the rear housing body 4 to define a rear heat receiving chamber RW arranged adjacent to a rear portion of the heat generating chamber 8 to receive therein the heat exchanging liquid which receives heat from the rear portion of the heat generating chamber 8.

The radially innermost circular fin 3*e* of the rear plate element 3 and a circular rib formed in a radially middle portion of the inner surface of the rear housing body 4 cooperate with one another to define a heat generation control chamber CR which fluidly communicates with the afore-mentioned through-bore 3*a*, i.e., the fluid withdrawing passage, the afore-mentioned through-bore 3*b*, i.e., the fluid supplying passage and the through-hole 3*d*, i.e., the subsidiary fluid supplying passage.

The front housing body 1 is provided with inlet and outlet ports (not shown in FIG. 1) for the heat exchanging liquid, which are arranged adjacent to one another in an outer circumference of the front housing body 1. The inlet port permits introduction of the heat exchanging liquid from an external heating system into the front and rear heat receiving chambers FW and RW, and the outlet port permits delivery of the heat exchanging liquid from the front and rear heat receiving chambers FW and RW toward the heating system.

The front housing body 1 is has a central hollow boss portion in which anti-friction bearings 10 and 11 are accommodated to rotatably support a drive shaft 12 having an inner end extending into the heat generating chamber 8. A portion of the inner end of the drive shaft 12 is sealed by a shaft sealing device 9 accommodated in the front plate element 2 at a position adjacent to the front region of the heat generating chamber 8.

A rotor element 13 is fixedly mounted on the inner end of the drive shaft 12 in a press-fit manner, so that the rotor element 13 is rotated together with the drive shaft 12 within the heat generating chamber 8. The rotor element 13 is formed as a flat disc-like element having flat opposite faces facing front and rear inner wall surfaces of the heat generating chamber 8. The rotor element 13 is provided with a plurality of through-bores 13*a* formed in a radially inner region of the flat faces thereof so as to provide a fluid communication between the front and rear portions of the heat generating chamber 8. The rotor element 13 is also provided with a plurality of through-bores 13*b* formed in a radially outer region of the flat faces thereof so as to apply a stronger shearing action to the viscous fluid (the silicone oil) when the rotor element 13 is rotated. As schematically shown in FIG. 1, the viscous fluid is supplied into the gaps between the outer faces of the rotor element 13 and the inner wall surfaces of the heat generating chamber 8, and into the heat generation control chamber CR. The amount of the viscous fluid supplied into the heat generation control chamber CR is adjusted so that the fluid level of the viscous fluid within the heat generation control chamber CR is constantly kept below the lowermost portion of the through-bore 3*a* formed as the fluid withdrawing passage. The through-bore 3*b* formed as the fluid supplying passage is constantly positioned below the fluid level of the viscous fluid within the heat generation control chamber CR.

It should be noted that a small amount of air is held in the heat generating chamber 8 and the heat generation control chamber CR as well as in the afore-mentioned through-bore 3*a* (the fluid withdrawing passage), the recessed groove 3*c* (the fluid supplying passage), and the through-hole 3*d* (the subsidiary fluid supplying passage) because, when the heat generator is assembled, atmospheric air unavoidably enters the heat generator.

The drive shaft 12 is driven by an external drive source, e.g., a vehicle engine via a pulley element fixed to an outermost end of the drive shaft 12 and a belt member (not shown).

A pair of bimetallic flap valves 14 and 15 functioning as thermo-sensitive control valves are arranged in the heat generation control chamber CR formed between the rear plate element 3 and the rear housing body 4. As best shown in FIG. 2, the bimetallic flap valve 14 is provided for usually closing the through-bore 3*a* functioning as the fluid withdrawing passage between the heat generating chamber 8 and the heat generation control chamber CR, and opening the through-bore 3*a* in response to a rise in the temperature of the viscous fluid (the silicone oil) in the heat generation control chamber CR, with respect to a predetermined temperature. The bimetallic flap valve 15 is provided for closing the through-bore 3*b* functioning as the fluid supplying passage between the heat generation control chamber CR and the heat generating chamber 8 in response to a rise in the temperature of the viscous fluid within the heat generation control chamber CR. The bimetallic flap valve 15 is usually moved away from its position closing the through-bore 3*b*. The bimetallic flap valves 14 and 15 are fixed at their ends thereof to the rear plate element 3 by suitable fixing means, e.g., screws.

Figure 5:
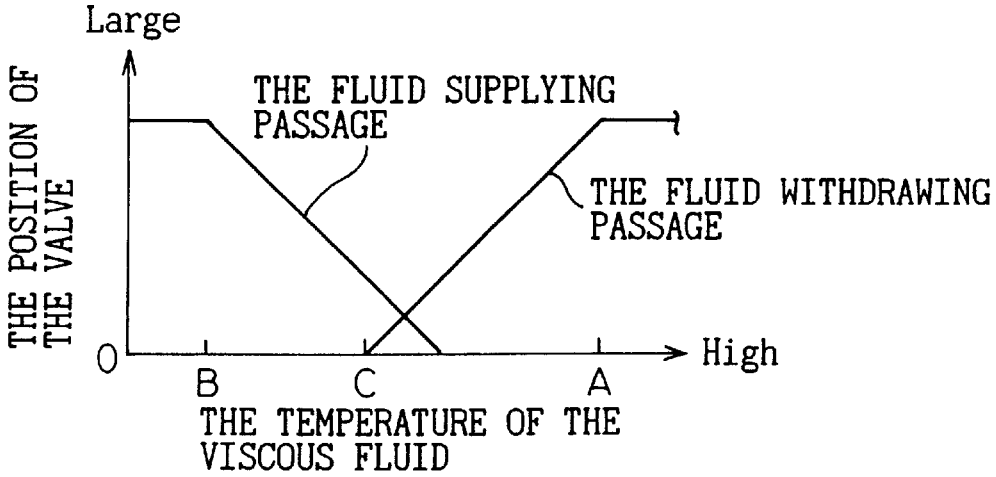
FIG. 5 is a graph illustrating a relationship between the temperature of the viscous fluid and the opening position of the valve means for opening and closing the fluid withdrawing and fluid supplying passages when the valve means is arranged in a state capable of quickly reducing the heat generating performance when the temperature of the viscous fluid is at a high temperature, with respect to the heat generator according to the copending Japanese Patent Application No.7-285266 (JP-A7-285266)
Figure 6:
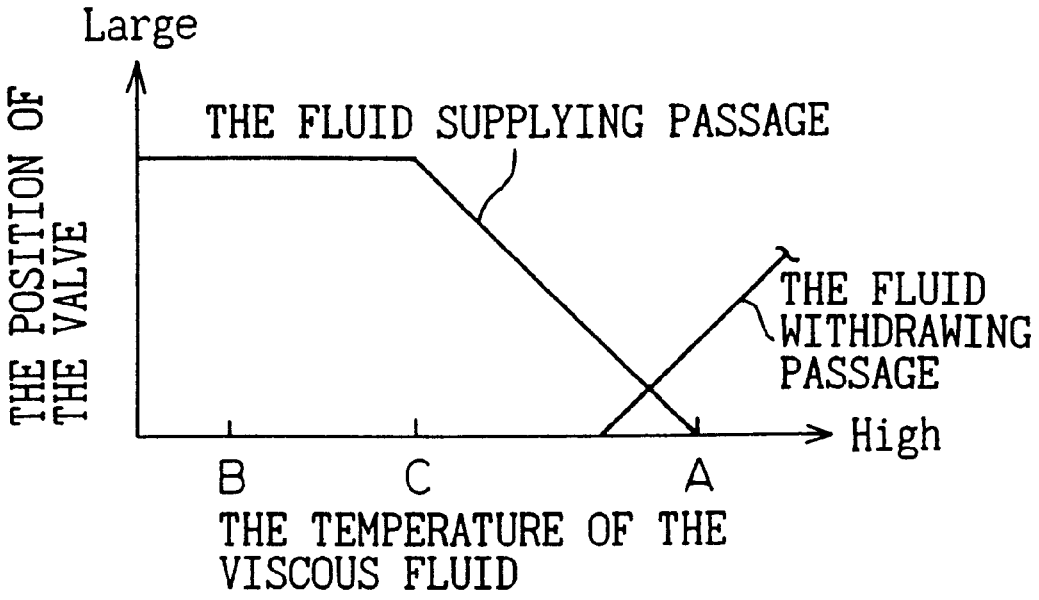
FIG. 6 is a graph illustrating a relationship between the temperature of the viscous fluid and the opening position of the valve means for opening and closing the fluid withdrawing and fluid supplying passages when the valve means is arranged in a state capable of quickly increasing the heat generating performance when the temperature of the viscous fluid is at a low temperature, with respect to the heat generator according to the copending Japanese Patent Application (JP-A-7-285266); and, FIG. 7 is a graph illustrating a relationship between the number of rotations of the drive shaft and a torque, with respect to an explanatory purpose heat generator modified from the heat generator according to the copending Japanese Patent Application (JP-A-7-285266).
Figure 7:
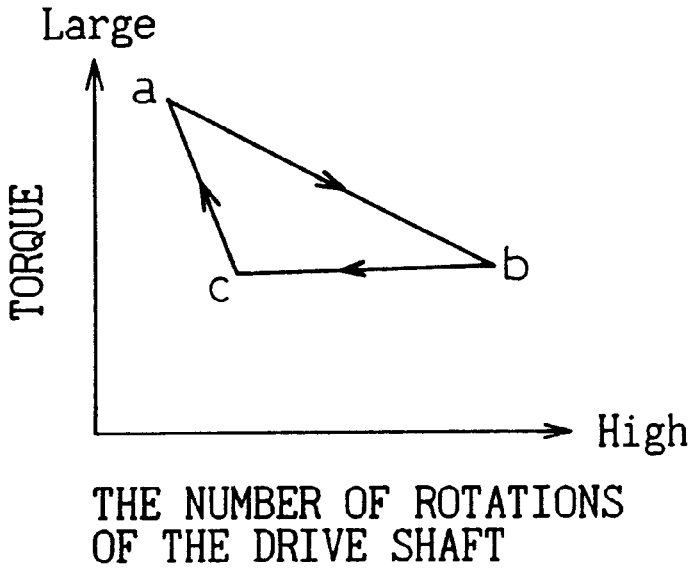

In the first embodiment of the present invention, the bimetallic flap valves 14 and 15 are arranged in such a manner that the heat generating performance of the heat generator is quickly reduced when the temperature of the viscous fluid (the silicone oil) reaches a given high temperature. More specifically, the heat generator is set so as to quickly reduce its heat generating performance at a given high temperature "A" of the viscous fluid shown in. FIG. 5, and to quickly increase its heat generating performance at a given low temperature "B" of the viscous fluid also shown in FIG. 5. To this end, the bimetallic flap valve 14 is disposed to completely open through-bore 3*a* (the fluid withdrawing passage) at the temperature "A", and simultaneously the bimetallic flap valve 15 is disposed to completely close the through-bore 3*b* (the fluid supplying passage) at the temperature "A". Further, the flap valve 14 is disposed to completely close the through-bore 3*a* at the temperature "B", and simultaneously, the bimetallic flap valve 15 is disposed to completely open the through-bore 3*b* at the temperature "B".

The operation of the viscous fluid type heat generator of the first embodiment of the present invention will be described hereinbelow with respect to an example in which the heat generator is incorporated in a vehicle heating system. It should be noted that the heat generator is mounted in the vehicle in such a state that the axis of rotation of the drive shaft is horizontal.

Before the starting of the heat generator, and when the drive shaft 12 is not driven by the vehicle engine, the silicone oil in the heat generating chamber 8 and that in the heat generation control chamber CR are maintained at an identical fluid level, due to a movement of the gas, i.e., the air, within the housing assembly, and due to gravity. Therefore, when the heat generator is started, the rotor element 13 applies a shearing action to only a small amount of silicone oil held in the heat generating chamber 8. Namely, the heat generator can be started by application of a small torque. Accordingly, a mechanical shock due to the starting of the heat generator can always be kept small.

After the starting of the heat generator by driving the drive shaft 12, the rotor element 13 is rotated within the heat generating chamber 8. Therefore, the silicone oil held in the heat generation control chamber CR is supplied into the heat generating chamber 8 via the opening fluid supplying passage formed by the through-bore 3*b* and the recessed groove 3*c*. Namely, the silicone oil is supplied into the lower peripheral region of the heat generating chamber 8. The silicone oil is then distributed to many regions within the heat generating chamber 8 including a central region thereof, due to the Weissenberg Effect acting on the silicone oil. Therefore, the silicone oil in the gaps between the outer faces of the rotor element 13 and the inner wall surfaces of the heat generating chamber 8 is subjected to a shearing action applied by the rotor element 13, and generates heat. The heat generated by the silicone oil is transmitted to the heat exchanging liquid flowing through the front and rear heat receiving chambers FW and RW. The heat exchanging liquid then carries the heat to the heating system to heat an objective heated area.

During the operation of the heat generator, when the rotating speed of the drive shaft 12 and the rotor element 13 is relatively kept small, the silicone oil within the heat generating chamber 8 is moved toward a radially central region of the heat generating chamber 8 due to the Weissenberg Effect rather than the centrifugal force acting on the silicone oil. It should be noted that since the flat disc-like rotor element 13 rotating within the cylindrical heat generating chamber 8 provides a large amount of flat surfaces on which the silicone oil is spread in a direction perpendicular to the axis of rotation of the rotor element 13. Thus, the silicone oil held between the inner wall surfaces of the heat generating chamber 8 and the outer faces of the rotor element 13 can be surely acted on by the Weissenberg Effect.

When the silicone oil within the heat generation control chamber CR is maintained at a relatively low temperature while the vehicle engine is rotating at a small rotating speed, an amount of heat supplied from the heat generator to the heating system is small. Thus, the bimetallic flap valve 14 maintains the closed position of the through-bore 3*a* (the fluid withdrawing passage), and the other bimetallic flap valve 15 maintains the opening position of the through-bore 3*b* (the fluid supplying passage). Thus, the silicone oil within the heat generating chamber 8 and that within the heat generation control chamber CR keep fluid continuity with one another via the through-bore 3*b* and the radial recessed groove 3*c*, due to the stretch viscosity of the silicone oil. Nevertheless, the fluid continuity between the viscous fluid in the heat generating chamber 8 and that in the heat generation control chamber CR via the closed through-bore 3*a* is cut. Thus, the supplying of the silicone oil from the heat generation control chamber CR into the heat generating chamber 8 via the through-bore 3*b* and the radial recessed groove 3*c* occurs without occurrence of the silicone oil from the heat generating chamber 8 into the heat generation control chamber CR. The silicone oil supplied into the gap between the rear face of the rotor element 13 and the rear inner wall surface of the heat generating chamber 8 is further supplied into the gap between the front face of the rotor element 13 and the front inner wall surface of the heat generating chamber 8, via the through-bores 13 of the rotor element 13. Accordingly, the heat generation by the silicone oil held between the opposite faces of the rotor element 13 and the inner wall surfaces of the heat generating chamber 8 is increased.

On the other hand, when the temperature of the silicone oil within the heat generation control chamber CR becomes high due to an increase in the rotating speed of the vehicle engine, the supply of heat from the heat generator to the vehicle heating system becomes excessive. Therefore, the bimetallic flap valve 14 opens the through-bore 3*a* (the fluid withdrawing passage, and simultaneously the bimetallic flap valve 15 closes the through-bore 3*b* (the fluid supplying passage). Thus, the silicone fluid in the heat generating chamber 8 has a fluid continuity with that in the heat generation control chamber CR via the through-bore 3*a* due to the stretch viscosity of the silicone oil. Nevertheless, a fluid continuity between the silicone fluid in the heat generating chamber 8 and that in the heat generation control chamber CR via the through-bore 3*b* and the radial recessed groove 3*c* is cut due to the closing of the through-bore 3*b*. Therefore, the silicone oil is withdrawn from the heat generating chamber 8 into the heat generation control chamber CR via the through-bore 3*a*, and a supply of the silicone oil from the heat generation control chamber CR into the heat generating chamber 8 does not occur due to the closure of the through-bore 3*b*. A small amount of silicone oil is constantly supplied from the heat generation control chamber CR into the heat generating chamber 8 via the through-hole 3*d* functioning as the subsidiary fluid supplying passage. The through-holes 13*a* of the rotor element 13 contributes to permitting the silicone oil held between the front face of the rotor element 13 and the front inner wall surface of the heat generating chamber 8 to be easily withdrawn into the heat generation control chamber CR. Accordingly, the silicone oil held between the outer faces of the rotor element 13 and the inner wall surface of the heat generating chamber 8 reduces the heat generating performance thereof so as to reduce the supply of heat from the heat generator to the vehicle heating system. Thus, the heating applied to the objective heated area is weakened. When the heat generating performance of the heat generator is reduced, even if a high rotating speed of the drive shaft 12 is maintained, the silicone oil within the heat generating chamber 8 is not heated to have a high temperature, and accordingly, degradation of the heat generating characteristics of the silicone oil can be prevented.

During the operation of the heat generator, the silicone oil is subjected to a shearing action by the rotor element 13 within the heat generating chamber 8, and the silicone oil contains therein the air in the form of the bubbles. However, since the through-bore 3*a* is always positioned above the fluid level of the silicone oil within the heat generation control chamber CR irrespective of a change in the fluid level within the chamber CR, the air can easily flow into the heat generation control chamber CR when the heat generating operation is performed within the heat generating chamber 8.

Further, in the heat generator of the first embodiment of the present invention, the movement of the silicone oil between the heat generating chamber 8 and the heat generation control chamber CR is smoothly carried out due to the effect of gravity on the silicone oil per se. Thus, replacement of the silicone oil in the heat generating chamber 8 with that in the heat generation control chamber CR occurs easily. Furthermore, in the described heat generator, the rotating rotor element 13 can easily draw the silicone oil from the heat generation control chamber CR into the heat generating chamber 8 through the fluid supplying passage, i.e., the through-bore 3*b* and the subsidiary fluid supplying passage, i.e., the radial recessed groove 3*c* by the stretch viscosity of the silicone oil. During the drawing of the silicone fluid from the heat generation control chamber CR into the heat generating chamber 8, since the subsidiary fluid supplying passage, i.e., the through-hole 3*d* is located below the fluid supplying passage, i.e., the through-bore 3*b*, the supply of the silicone oil through the subsidiary fluid supplying passageway can be very smooth. Thus, an increase and reduction in the heat generating performance of the heat generator are quickly achieved.

Figure 3:
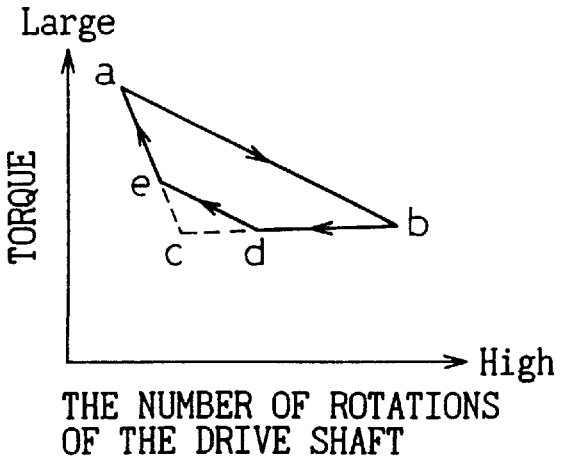
FIG. 3 is a graph illustrating a relationship between the number of rotations of a drive shaft and a torque with regard to the heat generator of the first embodiment and that of the applicant's copending Patent Application (JP-A-7-285266)

In the described heat generator of the first embodiment of the present invention, when the temperature of the silicone oil is at an intermediate value "C" shown in FIG. 5 between the high temperature "A" and the low temperature "B", leakage of the silicone oil from the heat generating chamber 8 to the heat generation control chamber CR via the through-bore 3*a* (the fluid withdrawing passage) may occur. Nevertheless, a constant supply of the silicone oil from the heat generation control chamber CR into the heat generating chamber 8 via the subsidiary fluid supplying passageway may compensate for the leakage of the silicone oil. Therefore, when the temperature of the silicone oil which is one of the controlling variables, is replaced with the rotation speed of the drive shaft 12, and the amount of heat generation is replaced with a torque, the relationship between the rotating number of the drive shaft 12 and the torque indicates a hysteretic curve a→b→d→e→a, as shown in FIG. 3. Namely, the curve indicates that when the heating system requires a quick supply of heat from the heat generator due to reduction of the rotating number of the drive shaft 12, since the toque is quickly increased from the point "d" to the point "e" without passing the point "c", a quick increase in the heat generation by the heat generator can be achieved. Thus, compared with the heat generator of the aforementioned copending Japanese Patent Application No. 7-285266, the heat generator of the present invention can quickly increase its heat generating performance when the temperature of the viscous fluid is low.

Therefore, the heat generator of the first embodiment of the present invention is able to both quickly increase and quickly reduce the heat generating performance thereof in response to a change in a requirement for heating. Further, since the increasing and reducing of the heat generating performance of the heat generator is carried out in response to a change in the temperature of the viscous fluid (the silicone oil) held within the heat generator, an external device for generating heating signals is not necessary. Therefore, the heating system including the viscous fluid type heat generator of the present invention can be a low-manufacturing-cost type heating system.

Further, in the above-described heat generator, during the withdrawing of the viscous fluid from the heat generating chamber 8 into the heat generation control chamber CR, and during the supplying of the viscous fluid from the heat generation control chamber CR into the heat generating chamber 8, the total inner volume of the heat generating chamber 8, the through-bore 3*a* (the fluid withdrawing passage), the through-bore 3*b* (the fluid supplying passage), the radial recessed groove 3*c*, the through-hole 3*d* (the subsidiary fluid supplying passage), and the heat generation control chamber CR are not changed. Thus, the movement of the viscous fluid (the silicone oil) does not generate a vacuum in the heat generator. Thus, the viscous fluid does not come into contact with fresh external air or any moisture. Therefore, degradation of the heat generating characteristics of the viscous fluid does not occur.

When the rotational driving of the drive shaft 12 by the vehicle engine is stopped, the viscous fluid, i.e., the silicone oil within the heat generating chamber 8 and within the heat generation control chamber CR moves to a state where the fluid levels of the silicone oil in the heat generating and heat generation control chambers 8 and CR are identical to one another due to the movement of the air and the gravity of the silicone oil. The movement of the air does not require any specified gas passage.

Further, the amount of the viscous fluid, i.e., the silicone oil can be easily regulated by initially filling the silicone oil into the heat generation control chamber CR so that the oil level of the silicone oil within the chamber CR is higher than the position of the opening of the through-bore 3*b* (the fluid supplying passage).

Figure 4:
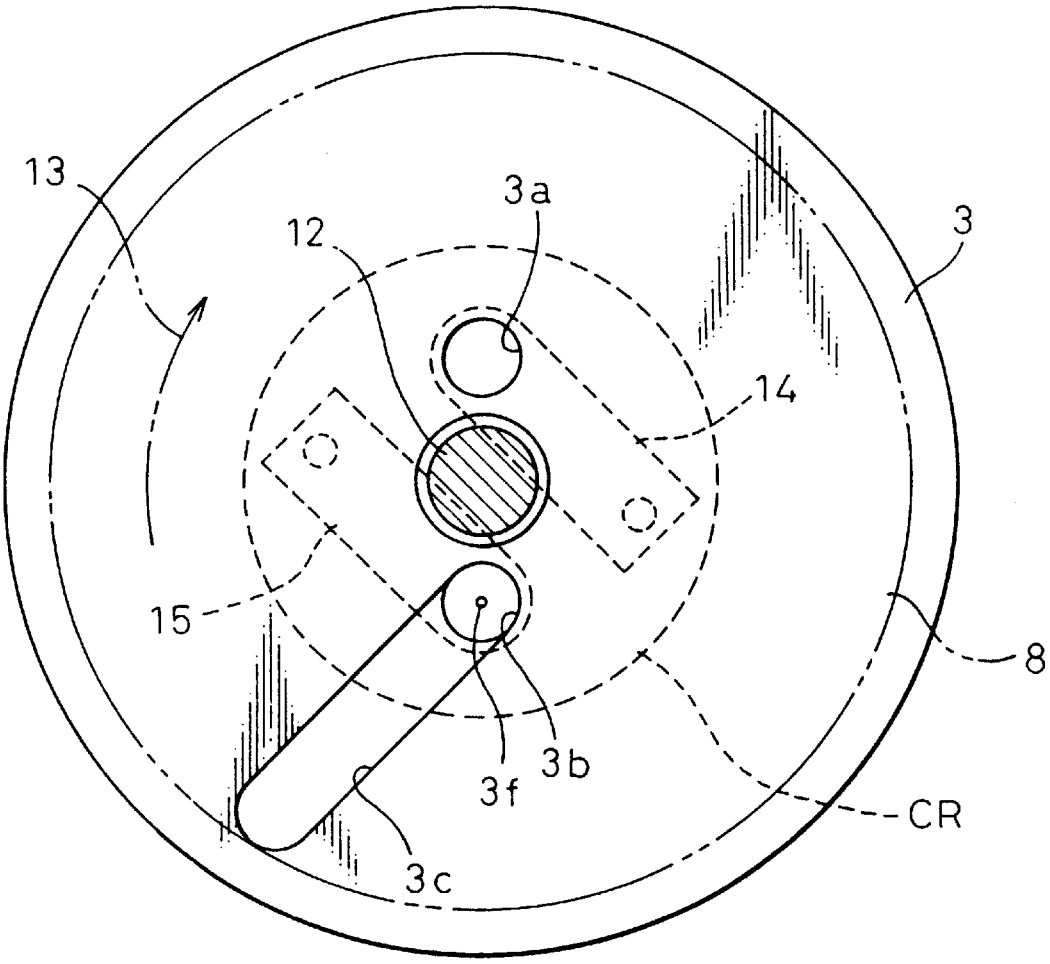
FIG. 4 is a plan view of a rear plate element incorporated in the heat generator according to the second embodiment of the present invention, viewed from the front side thereof.

Referring to FIG. 4, the viscous fluid type heat generator according to the second embodiment of the present invention is provided with such an internal construction that a through-hole 3*f* functioning as the subsidiary fluid supplying passageway for constantly supplying the viscous fluid from the heat generation control chamber CR into the heat generating chamber 8 is formed in the bimetallic flap valve 15. The remaining internal construction of the heat generator is the same as that of the heat generator of the first embodiment of the present invention, and therefore, it should be understood that the elements and parts except for the through-hole 3*f* are designated by the same reference numerals and have the same function or operation as those of the first embodiment.

Since the heat generator of the second embodiment shown in FIG. 4 is provided with the subsidiary fluid supplying passageway 3*f* formed in the flap valve 15, the forming of the subsidiary fluid supplying passageway can be simplified and can be achieved at a lower manufacturing cost.

It will be understood from the foregoing description that in accordance with the present invention, the viscous fluid type heat generator can quickly increase and reduce the heat generating performance thereof in response to a change in a requirement for heating from an objective heated area.

In the described first and second embodiments, the bimetallic flap valves employed for controlling the opening and closing the fluid withdrawing and fluid supplying passages may be replaced with any other type of valves such as a valve made of a shape memory alloy, and a suitable type of thermo-actuator.

Various changes and modifications will occur to persons skilled in the art without departing from the scope and spirit of the present invention as claimed in the accompanying claims.

What we claim is:

1. A variable heat generating performance, viscous fluid type heat generator comprising:

a housing assembly defining therein a fluid-tight heat generating chamber in which heat is generated, and a heat receiving chamber arranged adjacent to said fluid-tight heat generating chamber to permit a heat exchanging fluid to circulate therethrough to thereby receive heat from said fluid-tight heat generating chamber, said fluid-tight heat generating chamber having inner wall surfaces thereof;

a drive shaft supported by said housing assembly to be rotatable about an axis of rotation thereof, said drive shaft being operatively connected to an external rotation-drive source;

a rotor element mounted to be rotationally driven by said drive shaft for rotation together therewith within said fluid-tight heat generating chamber, said rotor element having outer faces confronting said inner wall surfaces of said fluid-tight heat generating chamber via a predetermined gap;

a viscous fluid, filling said gap between said inner wall surfaces of said fluid-tight heat generating chamber of said housing assembly and said outer faces of said rotor element, for heat generation during the rotation of said rotor element, wherein said housing assembly further comprises:

a heat generation control chamber formed therein to have a given amount of volume for containing said viscous fluid therein;

a fluid withdrawing passage for passing the viscous fluid from said heat generating chamber toward said heat generation control chamber to thereby permit at least a part of the viscous fluid in said heat generating chamber to be withdrawn into said heat generation control chamber, said fluid withdrawing passage having opposite open ends thereof;

a fluid supplying passage for passing the viscous fluid from said heat generation control chamber toward said heat generating chamber to thereby permit at least a part of the viscous fluid in said heat generation control chamber to be supplied into said heat generating chamber, said fluid supplying passage having opposite open ends;

a subsidiary fluid supplying passageway for providing a predetermined constant fluid communication between said heat generation control chamber and said heat generating chamber, said subsidiary fluid supplying passageway constantly supplying a given amount of viscous fluid from said heat generation control chamber to said heat generating chamber;

a fluid withdrawal control valve for openably closing at least one of the opposite open ends of said fluid withdrawing passage, said fluid withdrawal control valve opening at least one of the opposite open ends of said fluid withdrawing passage when the viscous fluid should be withdrawn from said heat generating chamber to reduce a heat generating performance of said heat generator; and, a fluid supply control valve for openably closing at least one of the opposite ends of said fluid supplying passage, said fluid supply control valve opening at least one of the opposite ends of said fluid supplying passage when the viscous fluid should be supplied from said heat generation control chamber into said heat generating chamber to increase the heat generating performance of said heat generator.

2. A variable heat generating performance, viscous fluid type heat generator according to claim 1, wherein when said drive shaft and said rotor element are arranged to have a substantially horizontal common axis of rotation thereof, said fluid withdrawing passage is formed to fluidly communicate with a central portion of said heat generating chamber arranged around the horizontal axis of rotation of said rotor element, so that the viscous fluid is withdrawn through said fluid withdrawing passage due to the Weissenberg Effect on the viscous fluid during the heat generating operation of said viscous fluid type heat generator.

3. A variable heat generating performance, viscous fluid type heat generator according to claim 1, wherein said subsidiary fluid supplying passageway is formed to have a cross-sectional area smaller than that of said fluid withdrawing passage.

4. A variable heat generating performance, viscous fluid type heat generator according to claim 1, wherein said drive shaft and said rotor element are arranged to have a substantially horizontal common axis of rotation thereof, said fluid withdrawing passage is arranged to have opposite open ends, one of which opens toward said heat generation control chamber in which a predetermined amount of the viscous fluid is initially filled to reach a given fluid level, and the other of which opens toward said heat generating chamber, said open end of said fluid withdrawing passage being arranged to be constantly positioned above said fluid level of the viscous fluid within said heat generation control chamber, regardless of a change in said fluid level of the viscous fluid, said fluid supplying passage is arranged to have opposite ends, one of which opens into said heat generation control chamber and is constantly positioned below said fluid level of the viscous fluid regardless of a change in said fluid level of the viscous fluid, and said subsidiary fluid supplying passageway is arranged to have opposite ends, one of which opens into said heat generation control chamber and is positioned below said open end of said fluid supplying passage.

5. A variable heat generating performance, viscous fluid type heat generator according to claim 1, wherein said fluid supplying passage comprises a recessed radial groove formed in a part of said inner wall surfaces of said heat generating chamber at a position facing said rotor element and radially extending toward a position adjacent to an outer periphery of said rotor element, said radial recessed groove of said fluid supplying passage having an end opening into said heat generation control chamber, and said subsidiary fluid supplying passageway is formed to fluidly communicate with said radial recessed groove of said fluid supplying passage, so that a part of the viscous fluid within said heat generation control chamber is constantly supplied into said heat generating chamber via said subsidiary fluid supplying passageway and said radial recessed groove of said fluid supplying passage.

6. A variable heat generating performance, viscous fluid type heat generator according to claim 1, wherein said fluid supply control valve of said viscous fluid type heat generator comprise a bimetallic flap valve arranged in said heat generation control chamber, said bimetallic flap valve closing said at least one of said opposite ends of said fluid supplying passage opening into said heat generation control chamber, in response to a rise in the temperature of the viscous fluid within said heat generation control chamber.

7. A variable heat generating performance, viscous fluid type heat generator according to claim 6, wherein said bimetallic flap valve is moved to an opening position thereof opening said at least one of said opposite ends of said fluid supplying passage opening into said heat generation control chamber, in response to a decrease in the temperature of the viscous fluid within said heat generation control chamber.

8. A variable heat generating performance, viscous fluid type heat generator according to claim 6, wherein said subsidiary fluid supplying passageway is arranged so as to pierce a portion of said bimetallic flap valve of said fluid supply control valve.

9. A variable heat generating performance, viscous fluid type heat generator according to claim 6, wherein said fluid withdrawal control valve of said viscous fluid type heat generator comprises a bimetallic flap valve arranged in said heat generation control chamber, said bimetallic flap valve being normally positioned to close said at least one of said opposite open ends of said fluid withdrawing passage opening into said heat generation control chamber, and moving away from said closing position thereof in response to a rise in the temperature of the viscous fluid.

10. A variable heat generating performance, viscous fluid type heat generator according to claim 1, wherein said rotor element applying a shearing action to the viscous fluid during the rotation thereof, comprises a flat rotary disc mounted on said drive shaft at a center thereof to thereby provide opposite circular flat faces facing said inner wall surfaces of said heat generating chamber.

11. A variable heat generating performance, viscous fluid type heat generator according to claim 10, wherein the viscous fluid is spread over said opposite circular flat faces of said flat rotary disc of said rotor element perpendicular to the axis of rotation of said rotor element.

12. A variable heat generating performance, viscous fluid type heat generator according to claim 1, wherein said rotor element is provided with at least one through-hole formed in a central portion thereof to provide a fluid communication between fluid holding gaps on opposite sides of said rotor element within said heat generating chamber, said through-hole of said rotor element permitting the viscous fluid to be easily withdrawn from said fluid holding gap between a front inner wall surface of said heat generating chamber into said heat generation control chamber through said through-hole when the heat generating performance of said heat generator should be reduced.

* * * * *